United States Patent [19]

Atwater

[11] Patent Number: 4,511,889

[45] Date of Patent: Apr. 16, 1985

[54] SURGE PROTECTED SMOKE ALARM

[75] Inventor: Richard G. Atwater, Brookfield, Ill.

[73] Assignee: Firex Corporation, Downers Grove, Ill.

[21] Appl. No.: 431,048

[22] Filed: Sep. 30, 1982

[51] Int. Cl.[3] ..... G08B 17/10

[52] U.S. Cl. ..... 340/629; 250/384; 333/181

[58] Field of Search ..... 340/629, 630; 250/381, 250/384, 385; 361/10, 11, 18; 381/94, 111, 117; 328/239, 240, 265; 455/297, 298, 299; 333/181

[56] References Cited

U.S. PATENT DOCUMENTS 2,066,149 12/1936 Hopkins ..... 328/239 X

*Primary Examiner*—James L. Rowland
*Assistant Examiner*—Daniel Myer
*Attorney, Agent, or Firm*—Welsh & Katz, Ltd.

[57] ABSTRACT

A smoke alarm for responding to alarm conditions using electrical circuitry having a horn coil placed in series with rectifier circuitry. The series connection of the horn coil with the rectifier circuitry enables suppression of line transients and also eliminates the need for additional transient suppression circuits. An alarm condition causes generation of a short circuit which activates the horn and causes current to pass through the horn; but the high impedance of the horn coil in the rectifier circuit limits the amount of current drawn to low levels for more efficient and safe operation of the smoke alarm. Further, the current flow in the horn will be substantially AC as a result of the series connection of the horn and rectifier circuitry, thereby eliminating the need for an alternate reset current path.

2 Claims, 3 Drawing Figures

A PRIOR ART CIRCUIT

SURGE PROTECTED SMOKE ALARM

This invention is generally related to smoke alarms. More particularly, this invention relates to smoke alarm circuitry which is uniquely protected from line current voltage surges.

BACKGROUND OF THE INVENTION

A smoke alarm comprises a smoke detector and its associated electrical circuitry. A typical modern day detector measures the amount of impurity in the air by detecting changes in an ionization current induced by a radioactive source.

In one embodiment the source may be an $\alpha$-emitter, located at a cathode, which ionizes the air to generate electrons collected at an anode. The anode is, of course, positively charged with respect to the cathode. A grid, called a plate, with a small hole through which current may pass, is located between the cathode and anode. Air surrounding the detector is permitted to enter freely into the space between the plate and the anode. The smoke detector operates as a voltage divider, the plate-cathode voltage decreasing accordingly as the ionization current decreases. The ionization current decreases as the amount of impurity, such as smoke, in the air in the anode-plate region increases.

Known smoke alarms are often made to operate in residential or commercial buildings from the utility electrical power supplies—typically 110–120 VAC at a nominal 60 Hz frequency. The alarms may be distributed throughout the buildings, each connected to an available outlet. The distributed alarms are then interconnected so that all the alarms are activated if any single one detects smoke. The alarms activate horns which may typically be ordinary bells, such as are useable as doorbells, each comprising a coil with a ferromagnetic core and a clapper.

The circuitry commonly associated with a detector is designed to respond to changes in the detector plate voltage when the detector anode is maintained at a substantially fixed positive voltage with respect to the cathode. Thus, such circuitry will necessarily include rectifier means for generating a substantially DC voltage to power the detector. Threshold detector circuitry responsive to the plate voltage of the smoke detector may then supply power to the horn when the plate voltage drops below a predetermined threshold. In existing detectors this is done by connecting one terminal of the horn to one terminal of the utility power supply through a current limiting resistor. The other terminal of the horn is connected to the other terminal of the power supply through a switch, which is usually an SCR. The threshold detector circuitry then closes the switch when the plate voltage drops below threshold. In this arrangement the horn is said to be connected in parallel with the rectifier means and the smoke detector.

There are several requirements that such smoke alarms must meet in order to be safe for use and otherwise commercially acceptable. The smoke alarms themselves must not, for example, be fire hazards. Consequently, they must be protected against voltage surges in the line supply which might, absent protection, burn out electrical components and cause sparking. Furthermore, the alarms should be dependable under normal voltage conditions. This goal may be met by minimizing the number of electrical components in the alarm circuitry. Also, a visual indicator, such as a light emitting diode, is often provided to show that the circuitry is operating normally. Commercial acceptability requires also that the smoke alarms be economical to purchase and use. The commercial goals are met by providing for a low initial cost—also a consequence of minimizing the number of circuit components—and minimal use of electrical power.

Line transients are very common in residential power supplies. Present line operated detectors employing SCRs as switches incorporate RC line snubbers to eliminate false triggering. The line snubbers undesirably add to the cost of the units and decrease circuit reliability because of the possibility of eventual capacitor degradation with resulting short circuits.

Current surge protection for present day line operated smoke alarms typically requires the use of a fuse or wire wound resistor. Either device allows a high surge current, which may be associated with a line transient or a short circuit, to reach and melt components in the detection device, possibly disconnecting power to the detector. The only indication of the blown fuse or open resistor will be extinguishing of the power-on indicator light. This indication may not be immediately noted if there are a large number of units in the building. Furthermore, large voltage surges may cause dangerous arcing in such alarm units.

An existing detector will typically activate its horn by applying a pulsating DC current to the horn coil. The DC component of the current produces a residual magnetization of the pole piece. The residual magnetization is undesirable because it reduces the inductance of the coil and consequently results in an increase in current flow during operation thereby increasing operating cost. Avoidance of the residual magnetization is presently achieved by establishing an alternate current path to provide a reset current during normal operation. The alternate current path requires the use of otherwise unnecessary electrical components.

Present systems suffer yet another disadvantage from the fact that they may operate unstably when the amount of impurities in the air is just at the threshold of the alarm condition. Under such conditions the impurities will generally not be uniformly distributed in the air and the detector may be exposed to different amounts of impurity at different moments. Thus, the smoke alarm will be in an alarm condition at one moment and a non-alarm condition at the next. It would be desirable to have a smoke alarm which changes its threshold once an alarm condition occurs so that a small decrease in smoke content will not put the detector back into a non-alarm condition. Such a change in threshold would effectively be a change of state of the smoke alarm circuitry, or hysteresis effect, stabilizing the alarm condition.

SUMMARY OF THE INVENTION

An embodiment in keeping with the principles of the present invention overcomes the disadvantages of present smoke alarms by using an electrical configuration in which the coil of the horn is placed in series with the rectifier circuitry, making the horn a part of the rectifier. The series connection provides an improved detector with a number of important advantages over the parallel connection presently employed.

Because of the series connection, the inductance of the horn coil advantageously provides line transient protection without the need for additional parts. The separate line transient suppression circuits are eliminated by the series connection.

Also, with the alarm horn in series, a short circuit produces an audible indication of its presence. When a short circuit occurs, current will pass through the horn activating the horn. However, the horn impedance limits the maximum current drawn through the horn to only approximately 60 ma. This current is insufficient to melt components or to start or maintain a flame producing arc.

Another advantage of the series connection is the fact that in normal operation the current in the horn will be substantially AC thereby eliminating the need for an alternate reset current path.

Yet another advantage of the series connection is the hysteresis effect that it provides.

These and other advantages, features and objects of the invention will be apparent from the following description of a specific construction of the preferred embodiment as illustrated in the accompanying drawing.

DETAILED DESCRIPTION OF A SPECIFIC CONSTRUCTION OF A PREFERRED EMBODIMENT

Figure 1:
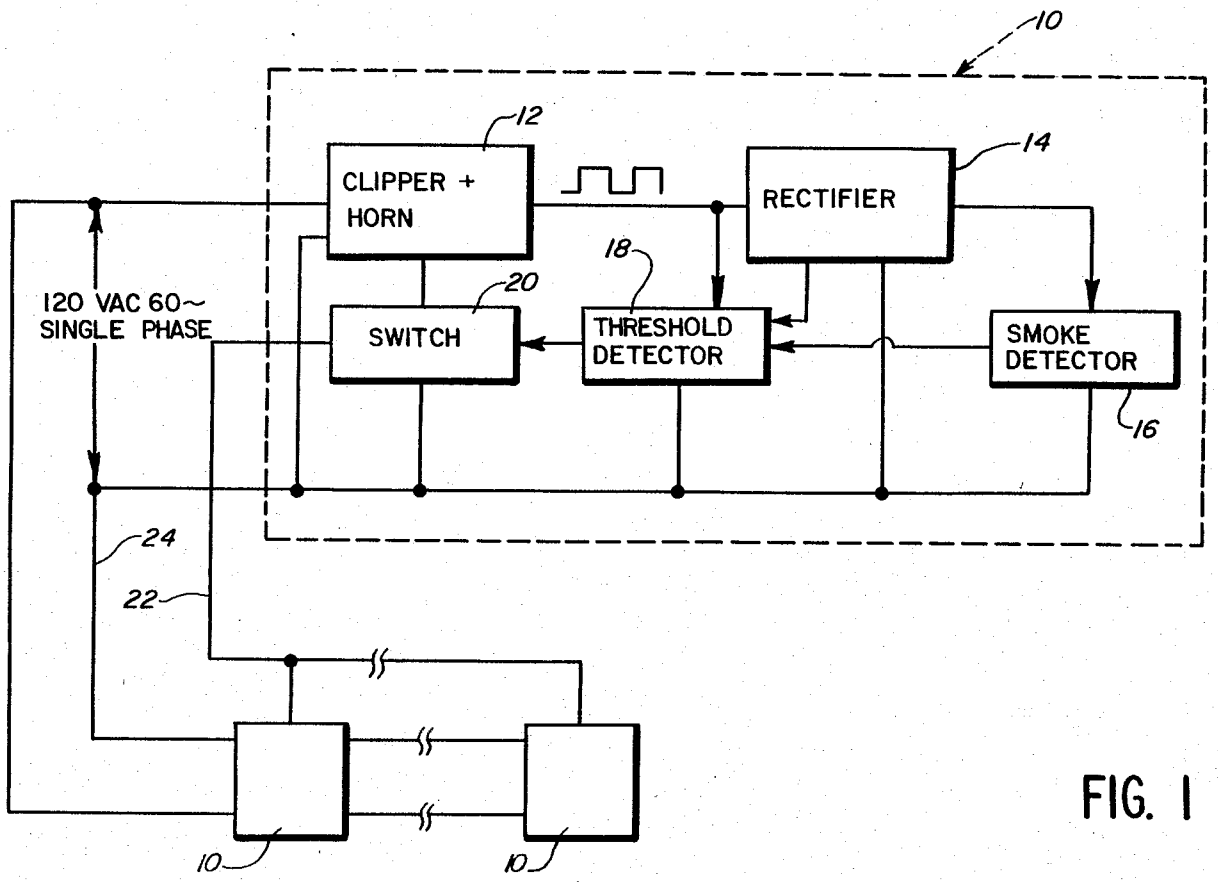
FIG. 1 is a generalized functional block diagram illustrating the major components of a smoke alarm.

Referring more specifically to FIG. 1, a smoke alarm 10 may be designed to operate on electrical power supplied from a 120 VAC 60 Hz single phase power supply such as is common in United States households. One terminal of the power supply, the power terminal, is connected to a clipper and horn 12 which outputs to a rectifier 14 which in turn provides a substantially constant DC voltage to a smoke detector 16 and to a threshold detector 18. The plate of the smoke detector 16 feeds the threshold detector 18 which outputs to a switch 20. The switch 20 connects the horn of the clipper and horn 12 between the power terminal of the line supply and the other terminal which functions as the common terminal. The common terminal provides the common or ground connection for the clipper of the clipper and horn 12, the rectifier 14, smoke detector 16 and threshold detector 18. It is customary to connect a plurality of smoke detectors 10 to the same power source with provision, by means of a line 22, to activate the horn in each detector if any single detector goes into an alarm condition.

The clipper portion of the clipper and horn 12 generates a square wave which is fed both to the switch 20 and to the rectifier 14. The rectifier 14 rectifies and filters the square wave to provide a substantially constant DC voltage to an anode of the smoke detector 16. The cathode of the smoke detector 16 which contains a radioactive source of alpha radiation, such as Americium, is tied directly to the common voltage. A plate with a small hole floats between the anode and cathode and has a voltage depending upon the ionization current generated by the radiation from the Americium source. Accordingly, when smoke particles enter the portion of the detector between plate and anode the ionization current decreases and the plate voltage drops.

The smoke detector plate voltage is detected by the threshold detector 18 which determines whether the plate voltage is above or below a predetermined threshold voltage generated in the threshold detector. When the threshold detector 18 detects the falling of the plate voltage below the predetermined threshold voltage it activates the switch 20 which connects the clipper and horn 20 to the common terminal to cause the line current to pass through the horn, thereby activating the horn. Simultaneously, the switch connects the other smoke alarm detector clipper and horns to the common terminal so that all the alarms are enabled together.

Figure 2:
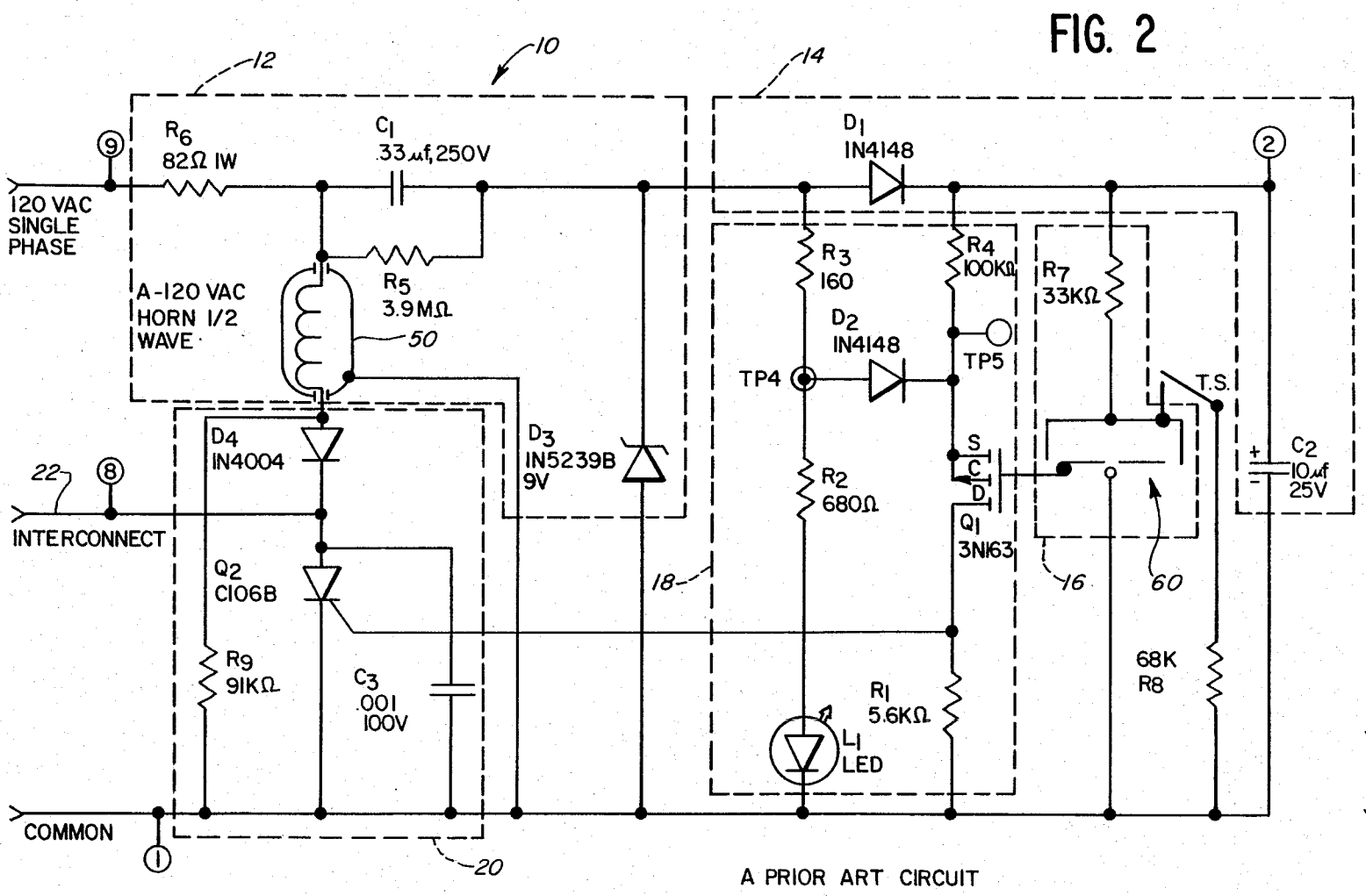
FIG. 2 is a circuit diagram illustrating a smoke alarm built in accordance with the prior art.

In the prior art it was known to connect the horn between the clipper and the common as shown in more detail in FIG. 2. However, as already pointed out, there were numerous difficulties arising from this method of connection. Accordingly, in the embodiment illustrated in FIG. 3, built in accordance with the principles of the present invention, the horn is connected between the line source power terminal and the clipping means where it also provides surge protection.

Accordingly, a smoke detector built in accordance with the principles of the present invention may comprise an ionization current smoke detector having a plate suitable for holding a floating plate voltage, a warning horn having an inductive coil, voltage clipping means for generating a square wave voltage from the AC line voltage, rectifying means connected to said voltage clipping means for rectifying said square wave to provide substantially constant voltage DC power connected to said smoke detector to power said detector, and threshold detection means connected to said smoke detector plate for setting a predetermined threshold voltage and determining when the smoke detector plate voltage exceeds said threshold voltage, said inductive coil being connected so that current passing through said voltage clipping means necessarily passes through said coil.

It may also be seen that a voltage surge protector for a smoke detector system powered by AC power may comprise a warning horn having an inductive coil connected in series with the remainder of said smoke detection system.

To fully understand the ramifications of placing the horn, or alarm module in series with the detector, a functional description of a prior art detector circuit is required.

With reference to FIG. 2, power is applied to the clipper and horn 12 from a conventional 120 V 60 Hz source.

The clipper and horn 12 includes an input resistor $R_6$ and capacitor $C_1$ connected in series. A bleeding resistor $R_5$ is connected across the capacitor $C_1$. A 120 VAC horn 50 has one terminal connected between $R_6$ and $C_1$. The remaining terminal of $R_6$ provides an input terminal to be connected to the power terminal of the line voltage source. A Zener diode $D_3$ is connected to limit the voltage difference between the remaining terminal of $C_1$ and the common terminal from the voltage source to +9 V during the positive half cycle of the 120 VAC. $R_6$ may be chosen to have a resistance of about 82Ω, and $C_1$ a capacitance of 0.33 μf. The bleeding resistor $R_5$ may conveniently have a resistance of 3.9 MΩ.

The input resistor $R_6$ serves as a limiting resistor and also attenuates line noise.

Power to the detection circuitry is coupled through $C_1$ which at 60 Hz has about 8 KΩ impedance. The current that flows through $C_1$ leads the voltage across it by about 90°. This current induces a voltage across the 9 V Zener diode $D_3$ which is also 90° out of phase with the input voltage.

The bleeding resistor $R_5$ is placed in parallel with the coupling capacitor $C_1$ to bleed off any charge left on $C_1$ when the unit is removed from the line.

It may accordingly be seen that the output of the clipper and horn 12 from the connection point between the Zener $D_3$ and capacitor $C_1$ will be a substantially square wave with a 60 Hz repetition rate, a peak voltage of approximately 9 V and a negative swing of about −1 V for the 1N5239B diode illustrated in FIG. 2. That output is fed to the rectifier 14.

The rectifier 14 comprises a diode $D_1$ having its anode connected to the output of the clipper and horn 12 and its cathode connected to filter capacitor $C_2$ which may be a 10 μf, 25 V capacitor having its other terminal connected to common.

$D_1$ and $C_2$ filter the pulsating voltage across $D_3$ to supply the the smoke detector 16 and threshold detector 18 with a substantially constant DC voltage. As a result of the large capacitance the detection circuit will be powered up and stable before any AC power is applied to the switch 20. Also, the smoke alarm 10 will look to the line as a nearly reactive load and will accordingly consume little power.

The threshold detector 18 comprises a voltage divider including resistors $R_3$ and $R_2$ and a light emitting diode $L_1$ connected respectively in series from the input to the rectifier 14 to common. An output from the rectifier 14 connects to a resistor $R_4$ which has its other terminal connected to the source of a MOSFET $Q_1$ which in turn has its drain connected to one terminal of a resistor $R_1$. The remaining terminal of resistor $R_1$ is connected to common. A switching diode $D_2$ has its anode connected to the juncture of the voltage divider resistors $R_3$ and $R_2$ and its cathode connected to the source of the MOSFET $Q_1$. The LED $L_1$ provides a power-on indication for the smoke alarm 10. The voltage divider provides, at the connection point of the diode $D_2$ anode, which is also labeled TP4 in FIG. 2, a predetermined threshold voltage. The threshold voltage at TP4 determines the cathode voltage at which the diode $D_2$ will conduct during the positive excursions of the square wave output from the capacitor $C_1$.

The switch 20 comprises a diode $D_4$ having its cathode connected to the anode of an SCR $Q_2$. The SCR $Q_2$ has its cathode connected to common and is bypassed to common through a capacitor $C_3$. The control grid of $Q_2$ is connected to the drain of the MOSFET $Q_1$ in the threshold detector 18. The anode of $D_4$ connects to the horn so that the switch 20 can switch AC power from the power terminal of the line source through $R_6$ to the common. The cathode of $D_4$ is also connected to the interconnect line 22 which forms a common connection among the anodes of all of the SCRs in the plurality of smoke detectors shown in FIG. 1. Diode $D_2$ and SCR $Q_2$ are bypassed to common by a 91 KΩ resistor $R_9$.

Diode $D_4$ is used to prevent power from reaching an LED in an interconnected unit if that unit loses connection to the high side of the line. For example, if two AC units were interconnected without $D_4$ and one of the units lost power through the high side of the AC line there would still be a current path through the two horns of the two detectors. As a result, current would be supplied to the LED of the detector which had lost power thereby incorrectly indicating a functioning detector. With diode $D_4$ in place, however, the LEDs are powered independently and serve as power-on indicators for the individual detectors. On the other hand, when units are connected together and one detector senses smoke and enables its SCR all horns are activated together with all of the horn currents going through the enabled SCR.

Resistor $R_9$ provides a current path through the horn to common when the smoke alarm 10 is in a no smoke condition and SCR $Q_2$ is off. This current is a reset current to keep the core of the horn 50 in a substantially demagnetized condition. The capacitor $C_1$ is part of a snubber circuit for line voltage surge protection.

The smoke detector 16 comprises a resistor $R_7$ and a conventional ionization current smoke detector 60. The cathode of the detector is connected to common and the anode to the output of the rectifier 14 through the resistor $R_7$. The plate of the detector is connected to the gate of the MOSFET $Q_1$ in the threshold detector 18. It may accordingly be seen that the voltage on the plate of the detector 60 controls the current flow from source to drain of the MOSFET $Q_1$. Sufficient current flow through the MOSFET will raise the voltage on the grid of $Q_2$ to turn on the SCR.

The operation of the conventional smoke detector may be understood from FIG. 2 by considering its operation with and without smoke in the smoke chamber between the plate and anode of the smoke detector 60.

When the smoke chamber is essentially free of smoke, the plate voltage is adjusted to approximately +5.0 V. The voltage of the FET source is then more positive than the plate voltage by slightly in excess of $-V_{gs}$ (off). In the illustrated construction the source of the FET will be at about +7.5 V. The voltage divider network of $R_2$, $R_3$, and $L_1$ keeps diode $D_2$ reverse biased with a peak anode voltage of about +7.0 V. The FET off drain current flow through $R_1$, a 5.6 KΩ resistor, of about 10 mA to 15 mA generates only about 50 mV to 75 mV at the SCR grid which is well below the 500 mV needed to turn on the illustrated C106B SCR.

When smoke particles enter the smoke chamber the voltage at the smoke detector 60 plate decreases as a result of the decreasing current in the detector. The resulting decreasing plate voltage increases the magnitude of $V_{gs}$ on $Q_1$, turning on the FET and increasing the drain current. The voltage drop across $R_4$ thereby increases. The increased voltage drop across $R_4$ switches the diode $D_2$ from a reverse bias to a forward bias condition and $D_2$ then conducts current during the positive half of the square wave from the clipper 12. The forward bias on $D_2$ keeps the source of the FET $Q_1$ clamped to the voltage at the $D_2$ anode, minus the forward drop of $D_2$, during the square wave peaks. During the square wave dips there is no supply for the divider network comprising $R_2$ and $R_3$, and the $D_2$ anode is at approximately the common voltage. At that time $D_2$ is again in its reverse biased state and the FET drain current is reduced because diode $D_2$ no longer supplies current to the FET. Accordingly, the FET $Q_1$ drain current amplitude will have an approximately square wave shape, following the square wave voltage from the clipper and horn circuit 12. The square wave current generates a square wave voltage across $R_1$. The voltage peaks across $R_1$ are about 500 mV, which is just sufficient to turn on the SCR $Q_2$. The voltage dips across $R_2$ are substantially less than 500 mV.

The capacitor $C_1$ produces a 90° phase shift between the voltage peaks across $R_1$ and the voltage peaks across the SCR $Q_2$. As a result $Q_2$ is enabled during a time when it is reverse biased. The SCR will then turn on as soon as the anode to cathode voltage passes the turn-on point so that a zero voltage turn on is normally effected. The presence of the snubber capacitor $C_3$ will, however, spoil the zero voltage turn on condition on the first cycle of an alarm.

It may be seen, then, that SCR $Q_2$ will be turned on during the time there is smoke in the detector. Current will be drawn through the horn 50 of each interconnected alarm system 10 during each positive half-cycle to establish an alarm condition activation of the horns. The alarm condition will continue until the plate voltage of the detector 60 increases to its no-smoke value to restore the reverse bias on the diode $D_2$.

Figure 3:
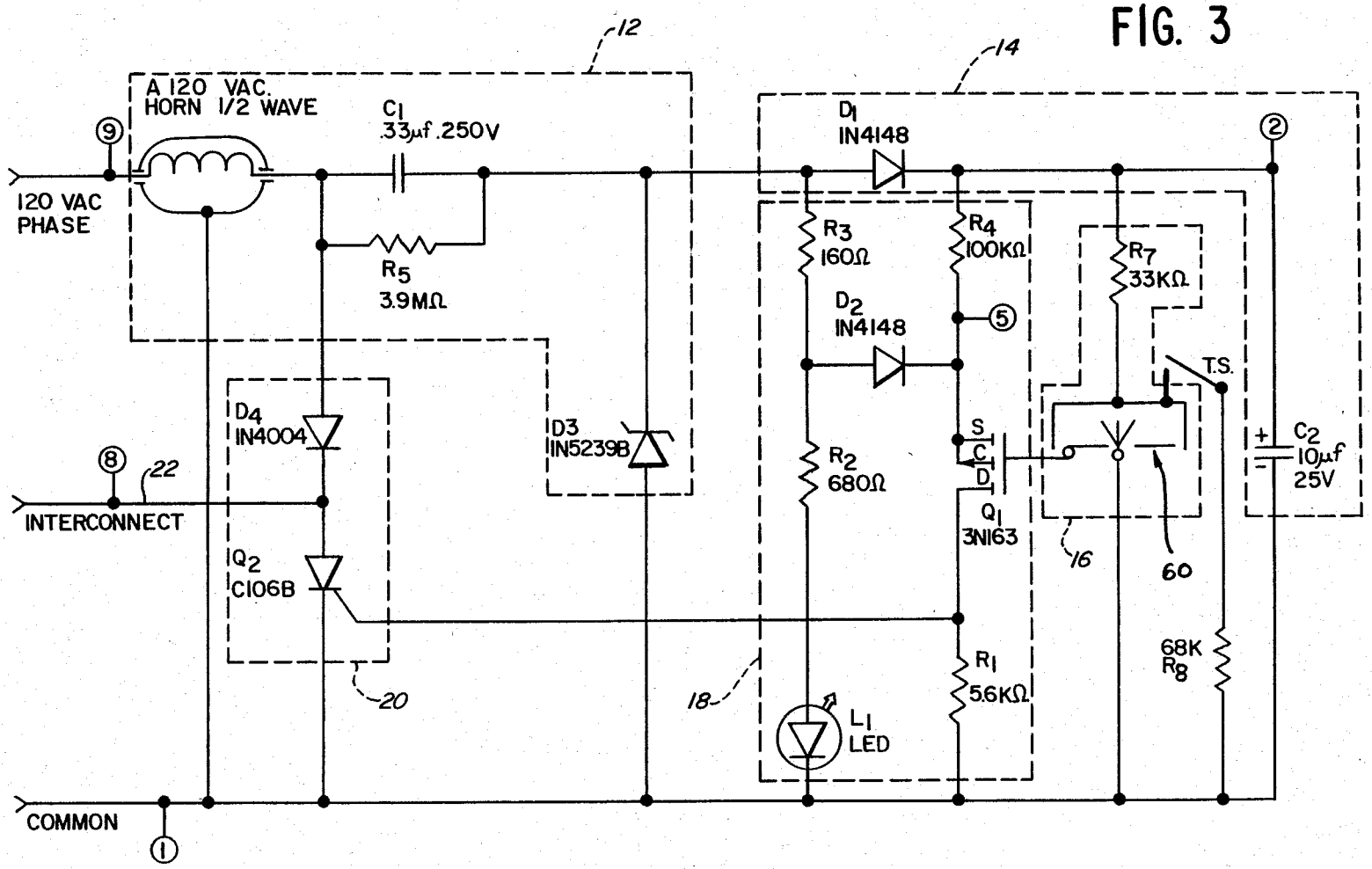
FIG. 3 is a circuit diagram illustrating a preferred embodiment of a smoke alarm built in accordance with the principles of the present invention.

FIG. 3 illustrates a preferred embodiment incorporating principles derived from the present invention. As shown in FIG. 3, the clipper and horn 12 of the preferred embodiment differs markedly from that of existing smoke alarms. The 82Ω resistor $R_6$ is no longer needed. It is replaced by the coil of the horn 60 and the anode of the diode $D_4$ is connected to the input capacitor $C_1$. The capacitor $C_3$ is also removed. As may be seen from FIG. 3 the coil provides the required transient protection in the no smoke condition by virtue of its inductance. No further protection is required.

When the horn is activated and the SCR conducts, the square wave developed across Zener $D_3$ will be further clipped because of the core saturation in the inductance of the horn 50. The square wave will have only about ¼ cycle rise time. The RMS value of the voltage will then be reduced and reflected as a 200 mV reduction of the voltage across capacitor $C_2$ the smoke detector 60 anode voltage supply. The 200 mV reduction of the anode will be reflected as about a 100 mV reduction of the plate voltage which is also the gate voltage of $Q_1$. Thus, the magnitude of $V_{gs}$ of $Q_1$ is increased to put $Q_1$ further into its on region. The alarm will therefore remain activated until the current increases enough to restore the extra 100 mV of bias resulting from the reduced duty cycle. Accordingly, the preferred embodiment will display a desirable hysteresis effect that will stabilize an alarm condition.

It will of course be understood that modification of the present invention and its various aspects would be apparent to those skilled in the art, some being apparent only after study and others being a matter of routine design. For example, the described embodiment is adapted for use with a particular model of smoke detector 60. However, this is not a necessary feature of the invention. In an alternative embodiment one might choose other types of detectors. It is to be appreciated, therefore, that the scope of the invention should not be limited by the particular embodiment and specific construction herein described, but should be defined only by the appended claims and the equivalents thereof.

What is claimed is:

1. A smoke alarm for operation from an AC line voltage source comprising:

an ionization current smoke detector having a plate suitable for holding a floating plate voltage, an AC voltage drive warning horn having an inductive coil connected to the AC source, voltage clipping means for generating a square wave voltage from the AC line voltage, rectifying means connected to said voltage clipping means for rectifying said square wave to provide substantially constant voltage DC power connected to said smoke detector to power said detector, and threshold detection means connected to said smoke detector plate for setting a predetermined threshold voltage and determining when the smoke detector plate voltage exceeds said threshold voltage, said inductive coil of said horn being connected in series between said AC line voltage and said voltage clipping means so that current passing through said voltage clipping means necessarily passes through said coil.

2. In an ionization current smoke detector and alarm apparatus of the type which is connected to an AC line voltage source and which has an ionization current smoke detecting means, a voltage clipping means for generating a square wave from the AC line voltage, a rectifying means for rectifying the square wave voltage and providing a substantially constant DC voltage to the detecting means, and an alarm horn having an inductive coil, the improvement comprising the alarm horn coil being series connected in circuit directly between the clipping means and the AC line voltage source.

* * * * *